US009309751B2

(12) United States Patent
Hall

(10) Patent No.: US 9,309,751 B2
(45) Date of Patent: Apr. 12, 2016

(54) ENTRY TUBE SYSTEM

(75) Inventor: Chris Hall, Cypress, TX (US)

(73) Assignee: WEATHERFORD TECHNOLOGY HOLDINGS LLC, Houston, TX (US)

( * ) Notice: Subject to any disclaimer, the term of this patent is extended or adjusted under 35 U.S.C. 154(b) by 618 days.

(21) Appl. No.: 13/302,327

(22) Filed: Nov. 22, 2011

(65) Prior Publication Data

US 2013/0126187 A1 May 23, 2013

(51) Int. Cl.
*E21B 43/04* (2006.01)
*E21B 17/18* (2006.01)

(52) U.S. Cl.
CPC ..... *E21B 43/04* (2013.01); *E21B 17/18* (2013.01)

(58) Field of Classification Search
CPC ..... E21B 17/18; E21B 43/04; E21B 47/06
USPC ..... 166/242.1, 242.3, 380
See application file for complete search history.

(56) References Cited

U.S. PATENT DOCUMENTS

| | | | | |
|---|---|---|---|---|
| 5,419,394 | A | 5/1995 | Jones | |
| 5,588,487 | A | 12/1996 | Bryant | |
| 5,842,516 | A | 12/1998 | Jones | |
| 5,848,645 | A | 12/1998 | Jones | |
| 6,220,345 | B1 * | 4/2001 | Jones et al. | 166/51 |
| 7,207,383 | B2 | 4/2007 | Hurst et al. | |
| 7,370,700 | B2 | 5/2008 | Hurst et al. | |
| 8,281,855 | B2 * | 10/2012 | Langlais | E21B 17/02 166/235 |
| 2005/0155770 | A1 * | 7/2005 | Parrott | 166/380 |
| 2007/0235186 | A1 * | 10/2007 | Sierra et al. | 166/250.07 |
| 2008/0283238 | A1 * | 11/2008 | Richards et al. | 166/228 |
| 2009/0266562 | A1 | 10/2009 | Greenaway | |

FOREIGN PATENT DOCUMENTS

| | | |
|---|---|---|
| EP | 2184436 | 5/2010 |
| GB | 2385616 | 8/2003 |
| GB | 2414497 | 11/2005 |
| JP | 2004324085 | 11/2004 |
| WO | 2011119197 | 9/2011 |

OTHER PUBLICATIONS

European Search Report dated Mar. 19, 2013, in corresponding application No. EP12193461.

* cited by examiner

*Primary Examiner* — Nicole Coy
*Assistant Examiner* — Kristyn Hall
(74) *Attorney, Agent, or Firm* — Blank Rome, LLP

(57) ABSTRACT

An entry tube system allows fluid to enter a chamber and flow to one or more shunt tubes connected to a downhole end of the entry tube. The fluid can enter the chamber about all or substantially all of the circumference of an inner mandrel disposed within the entry tube, and flow through the chamber to be directed into the shunt tubes.

32 Claims, 20 Drawing Sheets

ENTRY TUBE SYSTEM

TECHNICAL FIELD

The present invention relates to the field of downhole tools, and in particular to an entry tube system for use in a gravel pack.

BACKGROUND ART

The invention generally relates to shunt tubes used in subsurface well completions, and particularly to systems that provide improved fluid entry into shunt tubes.

Conduits providing alternate or secondary pathways (sometimes referred to as shunt tubes) for fluid flow are commonly used in well completions. The shunt tubes allow fluid to flow past and emerge beyond a blockage in a primary passageway. In some prior art embodiments, the single entrance to a shunt tube could be covered, blocked, or otherwise become inaccessible to the fluid, thereby preventing the shunt tube from performing its intended function. Such blockage could occur, for example, when the shunt tube happened to be positioned on the bottom wall of a horizontal bore. Other prior art embodiments provided multiple pathways by which fluid can enter alternate pathway conduits, spacing entrance tubes to prevent all of them from being simultaneously obstructed, covered, or otherwise blocked, but spaced entrance tubes limit the available open area to flow. Therefore, there is a continuing need for improved entrance mechanisms to provide improved access to the shunt tubes.

SUMMARY OF INVENTION

Full or nearly full circumference fluid flow is provided into an entry tube, allowing fluid to enter a chamber and flow to one or more shunt tubes connected to a downhole end of the entry tube. The fluid can enter the opening in any orientation of the entry tube system, and flow through the chamber to be directed into the shunt tubes.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

As used herein uphole generally means towards the surface of the well, while downhole means away from the surface of the well, regardless of the physical orientation of the wellbore. In a horizontally drilled well, for example, uphole may indicate a horizontal direction or a vertical direction, depending on the position at which the indication is made.

Figure 1:
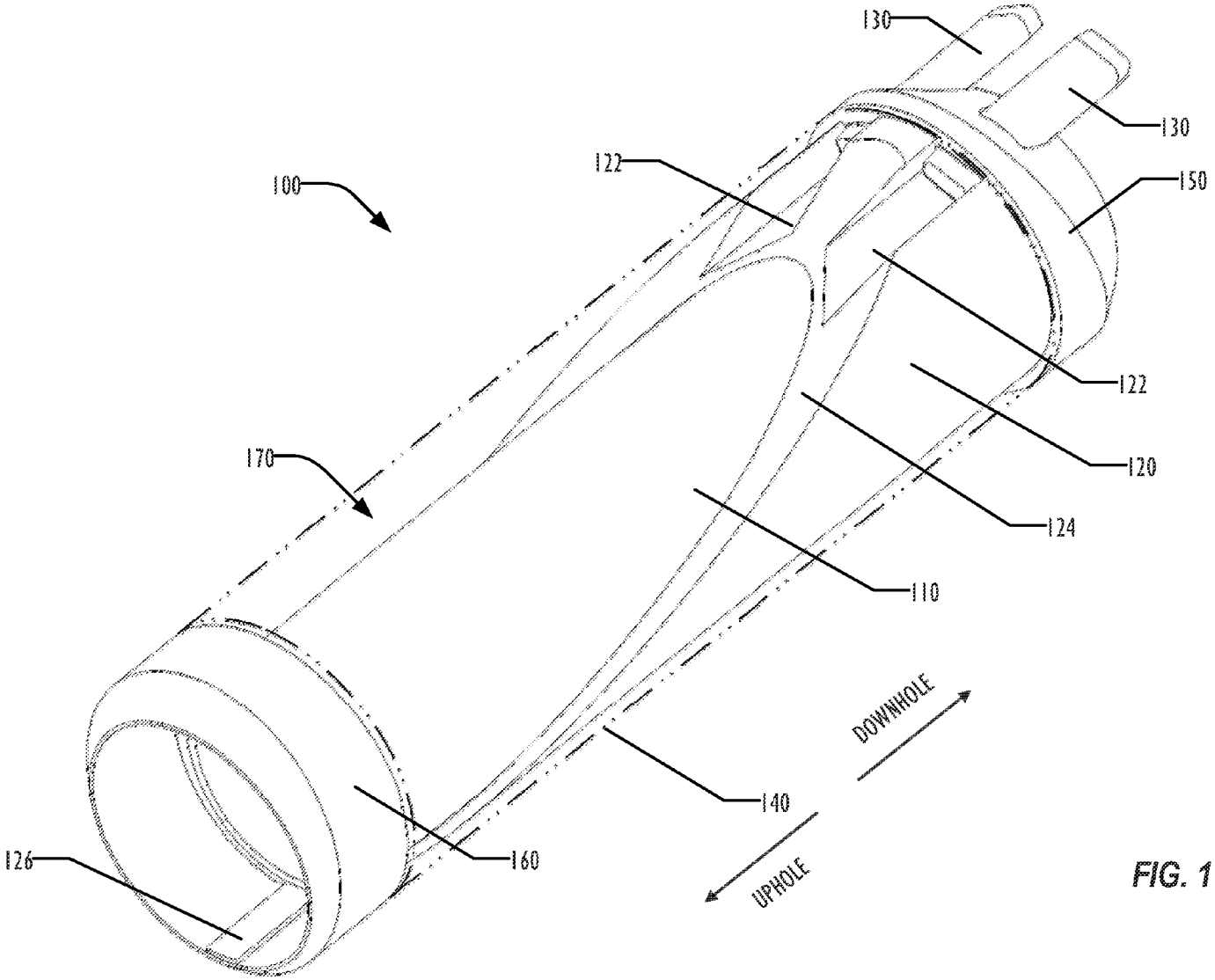
FIG. 1 is an isometric view of an entry tube system according to one embodiment.
Figure 2:
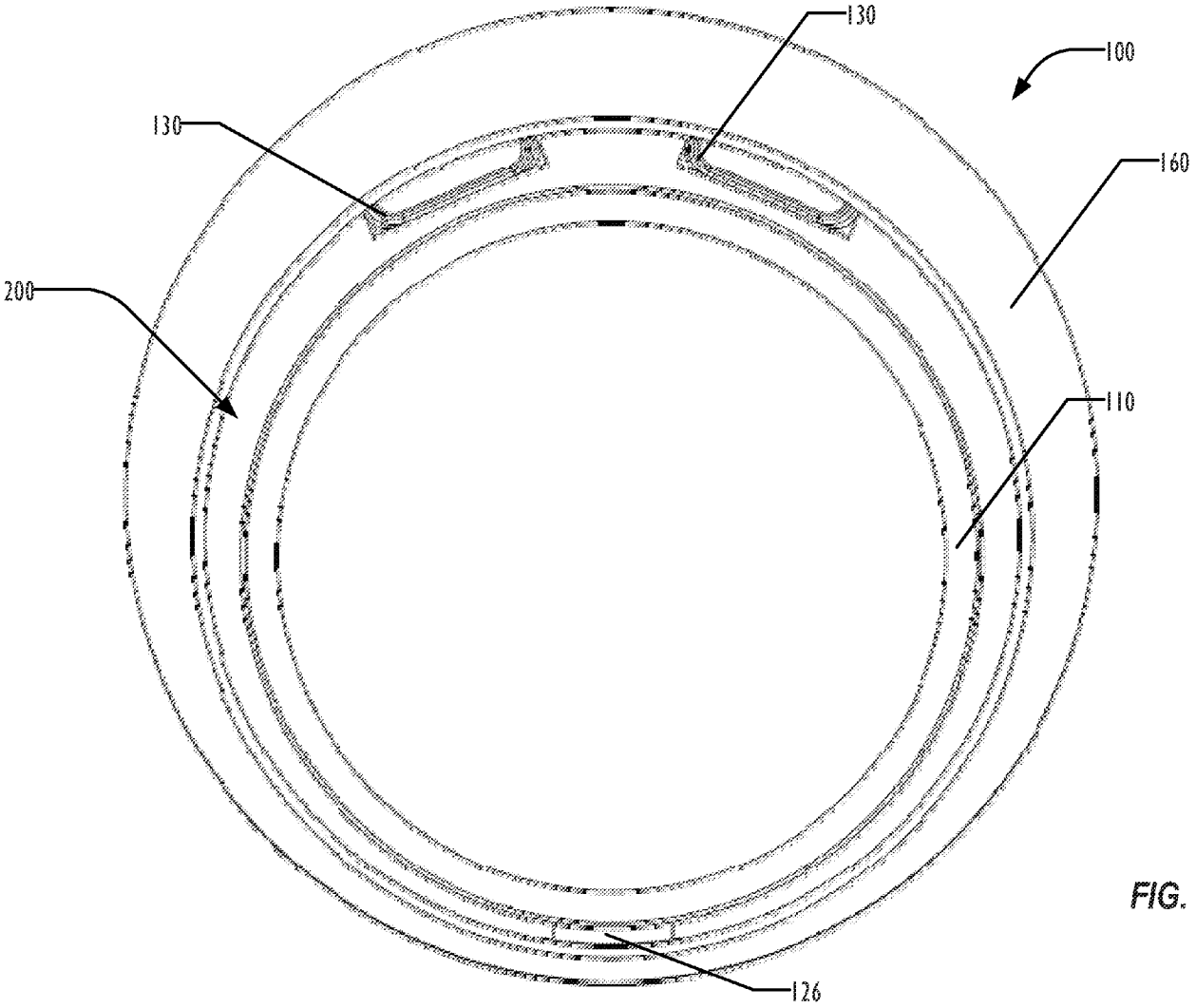
FIG. 2 is an end view of the entry tube system of FIG. 1.
Figure 3:
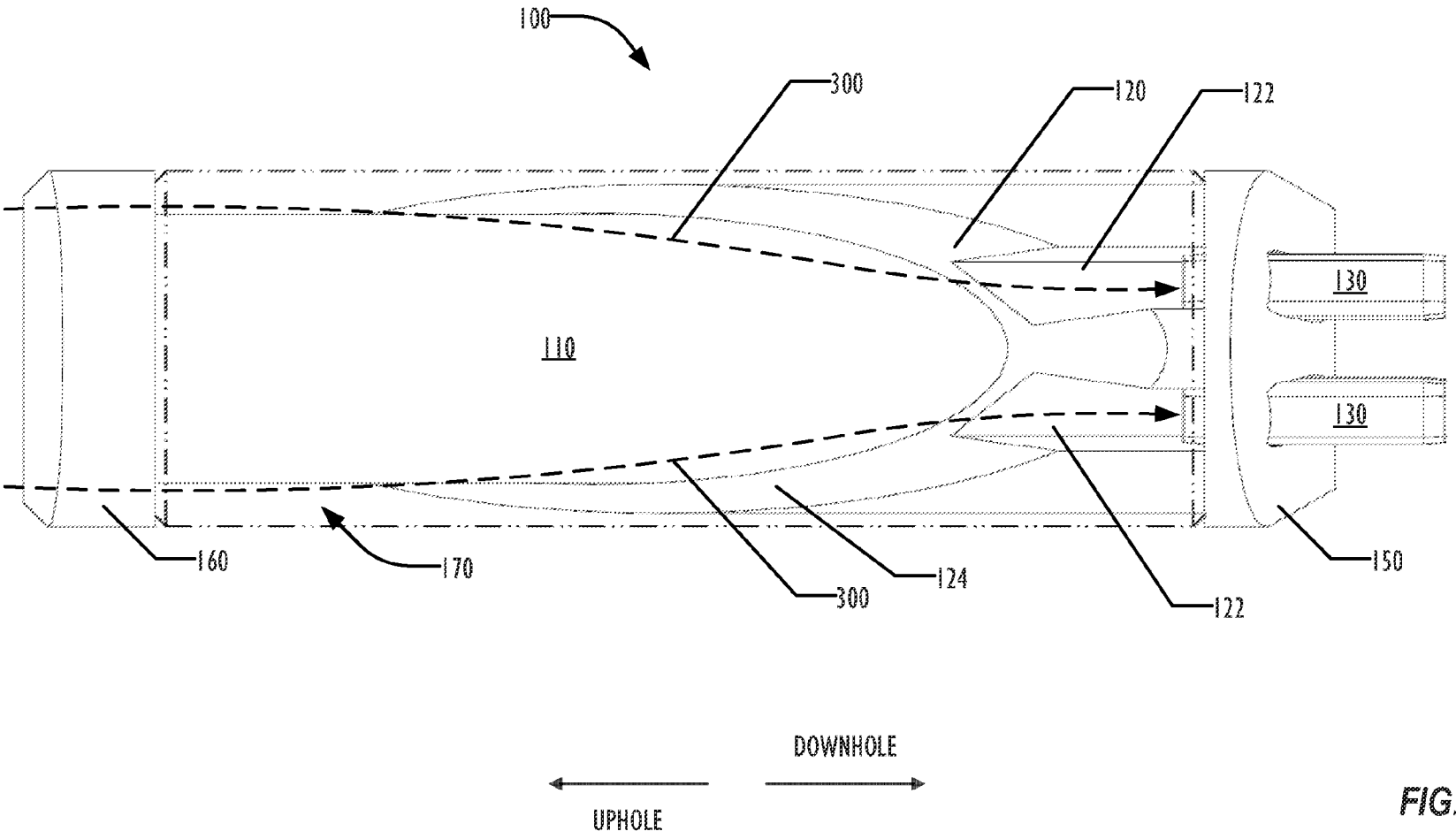
FIG. 3 is a top view of the entry tube system of FIG. 1.
Figure 4:
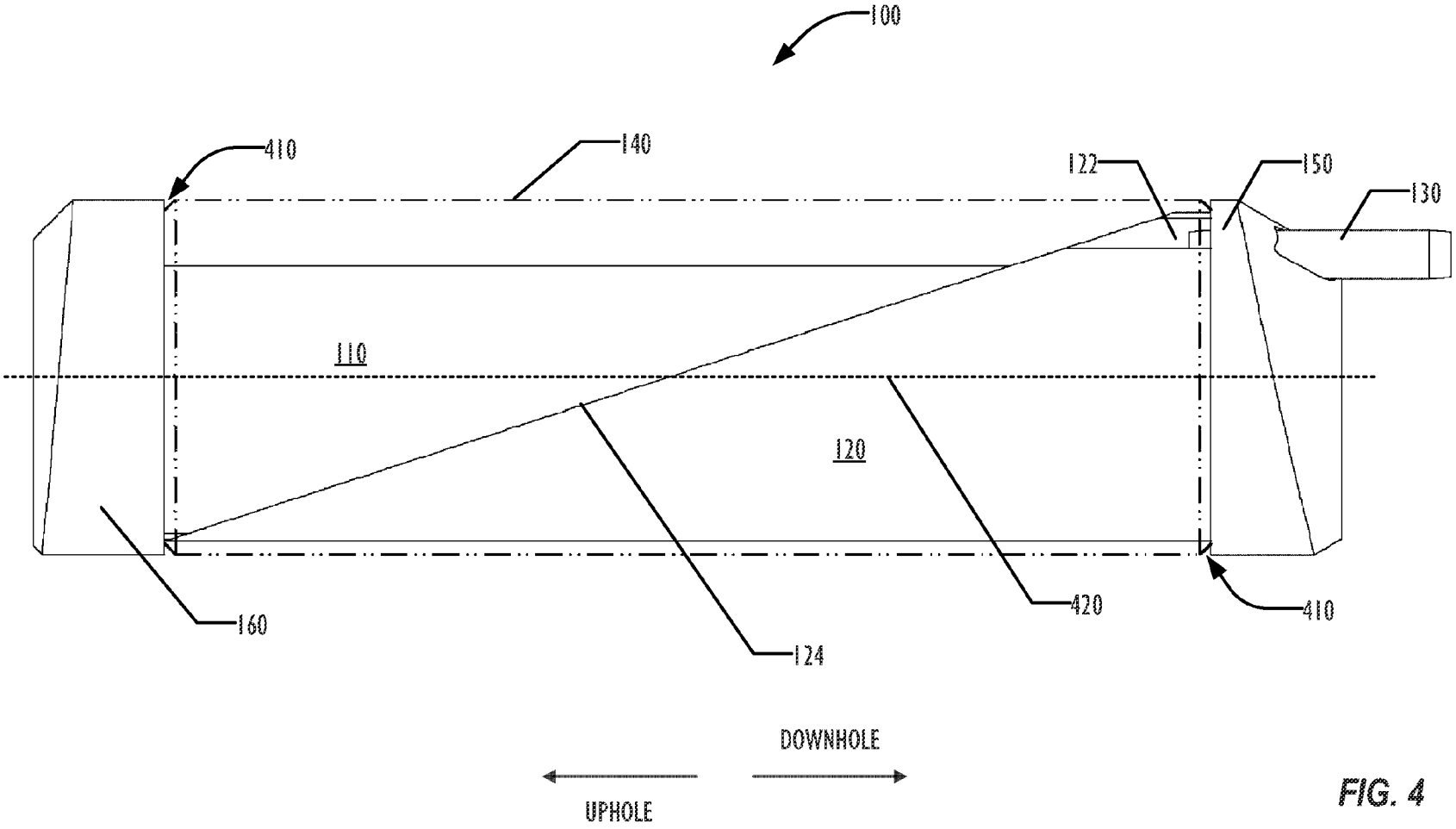
FIG. 4 is a side view of the entry tube system of FIG. 1.
Figure 5:
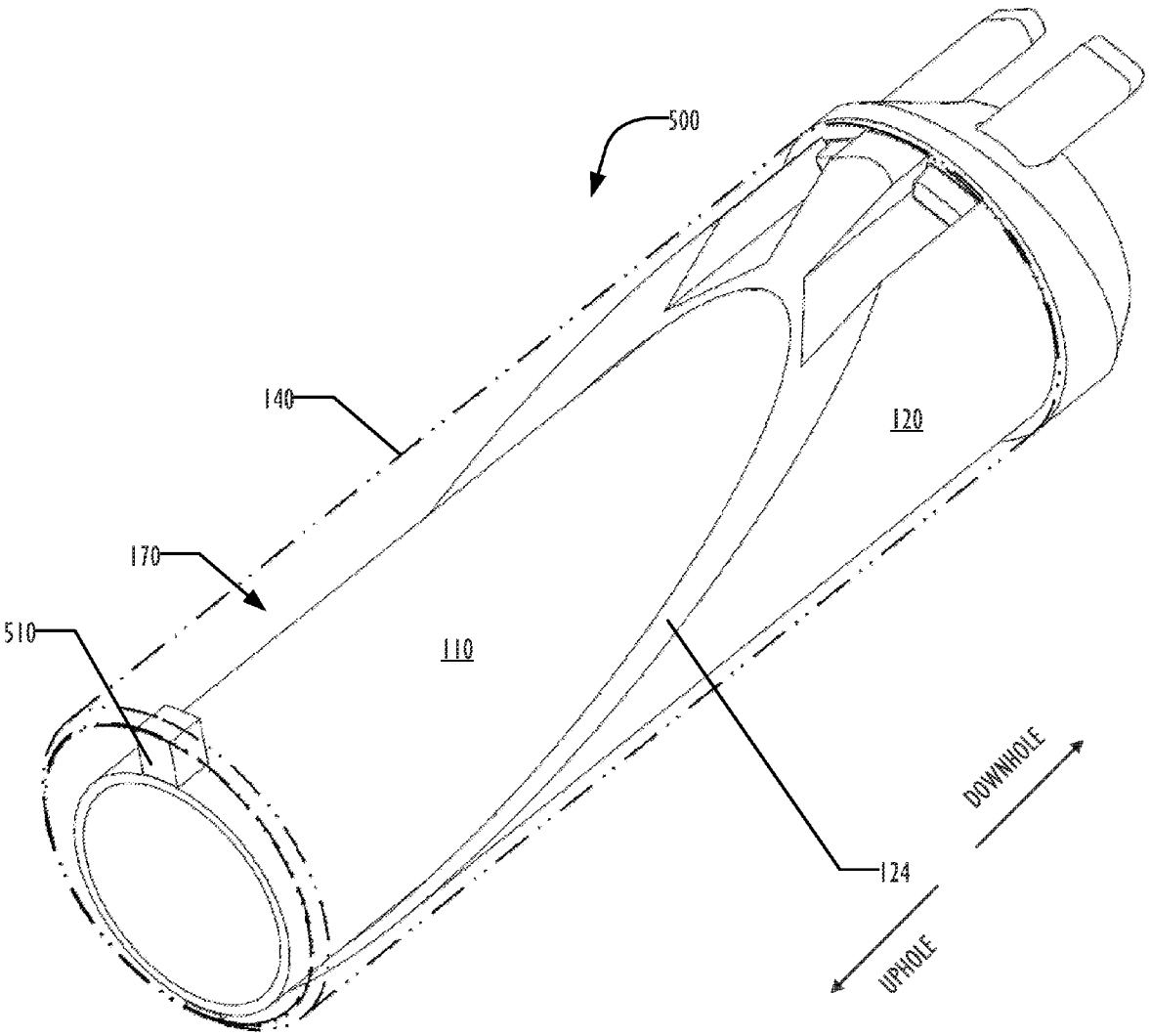
FIG. 5 is an isometric view of an entry tube system according to another embodiment.

FIG. 1 is an isometric view of an entry tube system 100 according to one embodiment, configured for use as a portion of a completion assembly for use in a well. FIG. 2 is an end view looking downhole at the entry tube system 100. FIG. 3 is a top view of the entry tube system 100, and FIG. 4 is a side view of the entry tube system 100; however, "top" and "side" are arbitrary orientations and should not be understood as referring to an orientation of the entry tube system in operation. The entry tube system 100 provides a large open area for fluid entry into one or more alternate path or shunt tubes 130, maximizing the open area to flow in the event of partial blockage, coverage, or obstruction. The entry tube system 100 may also cost less to manufacture than the prior art multiple entrance tube systems.

The entry tube system 100 may be manufactured at any desired diameter and length.

As illustrated in FIG. 1, a guide member 120 is disposed about an inner mandrel 110. The guide member 120 and the inner mandrel 110 may be concentric about a longitudinal axis of the inner mandrel 110, or the guide member 120 may be eccentric to the inner mandrel 110. An uphole end section 160 is disposed at an uphole end of the inner mandrel, providing an entryway for fluid. A downhole end section 150 is disposed at the opposite or downhole end of the inner mandrel 110. Shown as transparent in FIG. 1 to allow viewing the inner elements of the entry tube system 100, a generally cylindrical cover section 140 is disposed about the inner mandrel 110 and guide member 120 between the uphole end section 160 and downhole end section 150, forming a chamber 170 through which fluid (not shown) may flow. The cover 140, downhole end section 150, and uphole end section 160 form an entry tube through which the inner mandrel extends to form the chamber 170. In some embodiments discussed below, such as illustrated in FIGS. 5-8, the uphole end section 160 may be omitted from the entry tube.

The guide member 120 may extend from any first position along the inner mandrel 110 to the downhole end of the chamber 170.

One or more shunt tubes 130 are disposed through the downhole end section 150, with the end of the shunt tubes 130 opening into the chamber 170. The shunt tubes 130 serve as exit tubes for the entry tube system 100. Although two shunt tubes 130 are illustrated in FIG. 1, any number of shunt tubes 130 may be used as desired, including a single shunt tube 130.

The uphole end section 160 is preferably formed with a rounded, beveled, or otherwise angled configuration in an uphole direction, to minimize the possibility of damaging or blocking the uphole end section 160 by contact with irregularities in the wellbore when the entry tube system is moved in an uphole direction. Similarly, the downhole end section 150 is preferably formed with a rounded, beveled, or otherwise angled configuration in a downhole direction, to minimize the possibility of damaging or blocking the downhole end section 150 by contact with irregularities in the wellbore when the entry tube system is moved in an downhole direction. The shapes of the uphole end section 160 and downhole end section 150 as illustrated in FIGS. 1-4 are illustrative and by way of example only, and any desired shape may be used, including a squared off configuration.

The outer diameter of the uphole end section 160, the downhole end section 150, and the cover section 140 may be substantially equal. As best illustrated in FIG. 4, the ends of the cover section 140 may be beveled or otherwise reduced in diameter to allow a channel 410 for use when welding the cover section 140 to the uphole end section 160 and the downhole end section 150. In another embodiment, instead of reducing the diameter of the ends of the cover section 140, the downhole end of the uphole end section 160 and the uphole end section of the downhole end section 150 may be similarly reduced to provide the channel 410 for welding. In yet another embodiment, both the end sections 150, 160 and the cover section 140 may be tapered to form a notch for welding the elements together.

Although illustrated in FIGS. 1-4 with a substantially rectangular cross-section, the shunt tubes 130 may be formed with any desired cross-sectional configuration, including circular.

The inner mandrel 110 is illustrated in FIGS. 1-4 as being eccentrically positioned relative to the cover section 140 and opening of the uphole end section 160, as is best illustrated by FIGS. 2 and 4. However, in one embodiment, the inner mandrel 110 may be disposed concentrically with those elements about a longitudinal axis 420 of the assembled entry tube system 100.

The inner mandrel 110 may extend through or to an opening (not shown) in the downhole end section 150, allowing fluid flow through the inner mandrel 110 to other regions of the completion string as desired. In one embodiment, the inner mandrel 110 may be sized to slip over a tubular of a completion string (not shown), allowing the entry tube system 100 to be positioned at any desired position on the completion string. In another embodiment, the downhole end section 150, the uphole end section 160, and the guide member 120 may be movably positionable relative to a longitudinal axis of the inner mandrel. In an alternate embodiment, connectors (not shown) may be formed in the uphole end section 160 and the downhole end section 150 for threadedly or otherwise connecting the uphole end section 160 and the downhole end section 150 to portions of the completion string. In yet another alternate embodiment, connectors (not shown) may be formed on either end of the inner mandrel 110 for connecting the inner mandrel 110 to other portions of the completion string. Where connectors are used to connect the entry tube system 100 to other portions of the completion string, any desired type of connector known to the art may be used. In one embodiment, the inner mandrel 110 may be a portion of base pipe onto which the other elements may be positioned, as described in more detail in the discussion of FIGS. 13-20.

The guide member 120 is formed with a leading surface 124 that is generally tapered from the bottom of the inner mandrel 110 at the uphole end of the inner mandrel 110 to the top of the inner mandrel 110 at the downhole end of the inner mandrel 110. The taper of the leading surface 124 may be straight or curved as desired, such as a helical taper. The tapered leading surface 124 directs fluid entering through the uphole end section 160 into the chamber 170 around the inner mandrel 110 towards the ends of the shunt tubes 130, regardless of the orientation of the entry tube system 100, as illustrated by example paths 300 in FIG. 3.

In one embodiment, the guide member 120 may be formed of a material harder than the inner mandrel 110, to reduce erosion from the fluid guided into the shunt tubes 130 by the tapered surface 124.

The taper of the tapered surface 124 may be as steep as desired, although a gradual taper is preferred to prevent fluid flow problems.

In one embodiment, channels 122 may be formed in the guide member 120 at a proximal to the shunt tubes 130 to further direct the flow of fluid through the channels 122 into the shunt tubes 130. In such an embodiment, an equal number of channels 122 and shunt tubes 130 may be used.

In one embodiment, a nose element 126 of the guide member 120 may extend beyond the uphole edge of the inner mandrel 110 towards an uphole end of the uphole end section 160, to allow welding or otherwise affixing the guide member 120 to the uphole end section 160. In one embodiment, the inner mandrel 110 is welded or otherwise affixed to the guide member 120, but is not welded or otherwise affixed to the uphole end section 160. In one embodiment, the guide member 120 may be welded or otherwise affixed to the downhole end section 150.

In one embodiment, the uphole end of the inner mandrel 110 may be configured to key the inner mandrel 110 to the downhole end of the uphole end section 160, providing additional support.

In another embodiment, the guide member 120 may be omitted. In such an embodiment, the fluid would simply flow into the chamber 170 around the inner mandrel 110 into the shunt tubes 130, but would not be guided toward the shunt tubes as illustrated in FIGS. 1-4.

In yet another embodiment, the inner mandrel 110 may be omitted. In such an embodiment, the chamber 170 is formed by the cover section 140, and the uphole end section 160 and downhole end section 150 may be connected to other portions of the completion string using any connection technique known to the art. In a further embodiment, the guide member 120 may be positioned in the chamber 170 without the inner mandrel 110, wherein the tapered surface 124 is a solid tapered surface, instead of being formed around the circumference of the inner mandrel 110 as illustrated in FIG. 1.

In another embodiment, instead of extending into the chamber 170 as illustrated in FIGS. 1-4, the uphole ends of the shunt tubes 130 may be positioned flush with the uphole end of the downhole end section 150. In such an embodiment, the channels 122 may be omitted.

FIG. 2 is an end view illustrating the entry tube system 100 of FIG. 1 according to one embodiment. As illustrated, the uphole end section 160 and inner mandrel 110 form an inlet 200 that is eccentric relative to the circumference of the uphole end section 160, corresponding to the position of the inner mandrel 110. As illustrated in FIG. 2, the inlet 200 allows flow of fluid around nearly the entire circumference of the inner mandrel 110, except for the portion blocked by the nose element 126 of the guide member 120. The fluid may thus flow into the chamber 170, to be guided by the guide member 120 to the openings of the shunt tubes 130 for flow through the shunt tubes 130.

In one embodiment, the nose element 126 may be omitted and the inner mandrel 110 may be sealed to the inner diameter of the uphole end section 160 along a portion of the circumference of the inner mandrel 110. In another embodiment, the inner mandrel 110 may be welded or otherwise affixed along that portion of the circumference of the inner mandrel 110 to provide additional support.

Because shunt tubes 130 are alternate pathway conduits, used to convey fluid past a blockage, the entry tube system 100 may include one or more elements to restrict fluid from entering the entry tube system 100 through the uphole end section 160 into the chamber 170 until shunt tubes 130 are needed. In one embodiment, restriction members (not shown) such as valves or rupture discs may be placed across the uphole opening of the uphole end section 160, configured to allow fluid flow only if the pressure exceeds a predetermined threshold pressure. By using rupture discs, for example, fluid flow through the entry tube system 100 into the shunt tubes 130 would be prevented under normal operating pressures. However, if a blockage (bridging) occurred, pressure in the annular region could be increased until one or more discs burst at a predetermined pressure, allowing fluid to pass.

In operation, a fluid such as a gravel slurry or fracturing fluid is pumped into an annular region between a production zone of the well and the completion string. In some embodiments, the fluid may be initially pumped through a work string down to a crossover mechanism which diverts the flow into the annular region some distance below the well surface. When the fluid encounters the entrance tube system 100, in the absence of restrictor devices the fluid flows through the inlet 200 and through the chamber 170 into the shunt tubes 130. Because the inner mandrel 110 is of a smaller diameter than the internal diameter of the uphole end section 160, there is a fluid path through inlet 200 into chamber 170, and a guided fluid path in chamber 170 into the shunt tubes 130. That insures the fluid can pass into shunt tubes 130 regardless of the orientation of the entry tube system 100 in the wellbore. In those embodiments employing restrictor devices, the fluid may be restricted from passing into the chamber 170 until the restriction devices are defeated.

The relative size of the outer diameter of inner mandrel 110 to the inner diameter of the uphole end section 160 may be determined as desired, to vary the size of the inlet around the inner mandrel 110 into the chamber 170.

In one embodiment, channels or ribs may be formed longitudinally on the inner mandrel 110 to further guide the fluid toward the shunt tubes 130.

FIGS. 5-8 illustrate another embodiment of an entry tube system. As illustrated in FIGS. 5-8, member 510 provides support for the cover section 140 at the uphole end of entry tube system 500. Member 510 may be welded or otherwise affixed to the cover section 140, the inner mandrel 110, or both, and prevents unwanted movement of the uphole end of the inner mandrel 110 relative to the cover section 140. Except for the uphole end of the entry tube system 500 as described below, the entry tube system 500 may be identical to the entry tube system 100.

Figure 6:
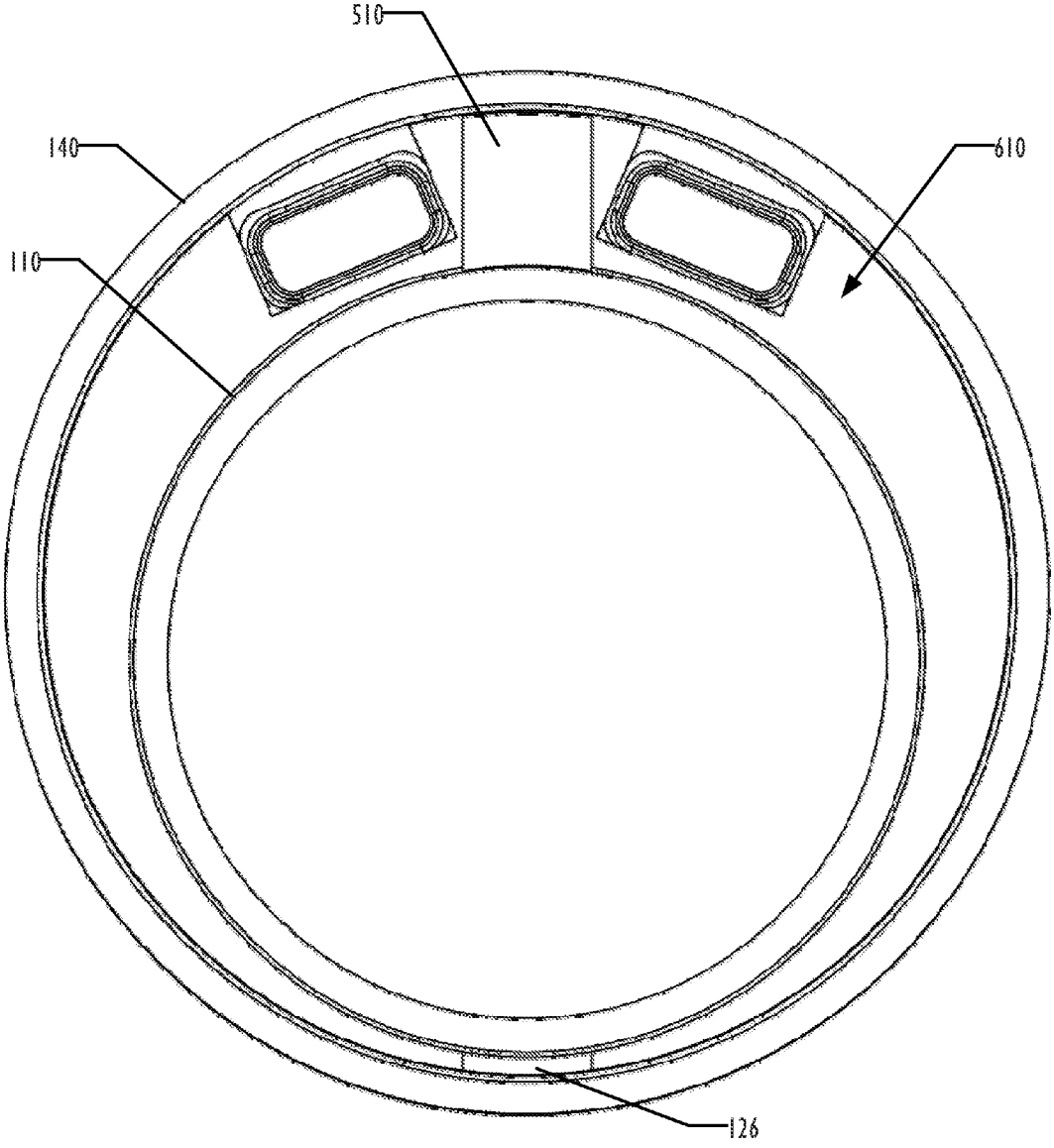
FIG. 6 is an end view of the entry tube system of FIG. 5.
Figure 7:
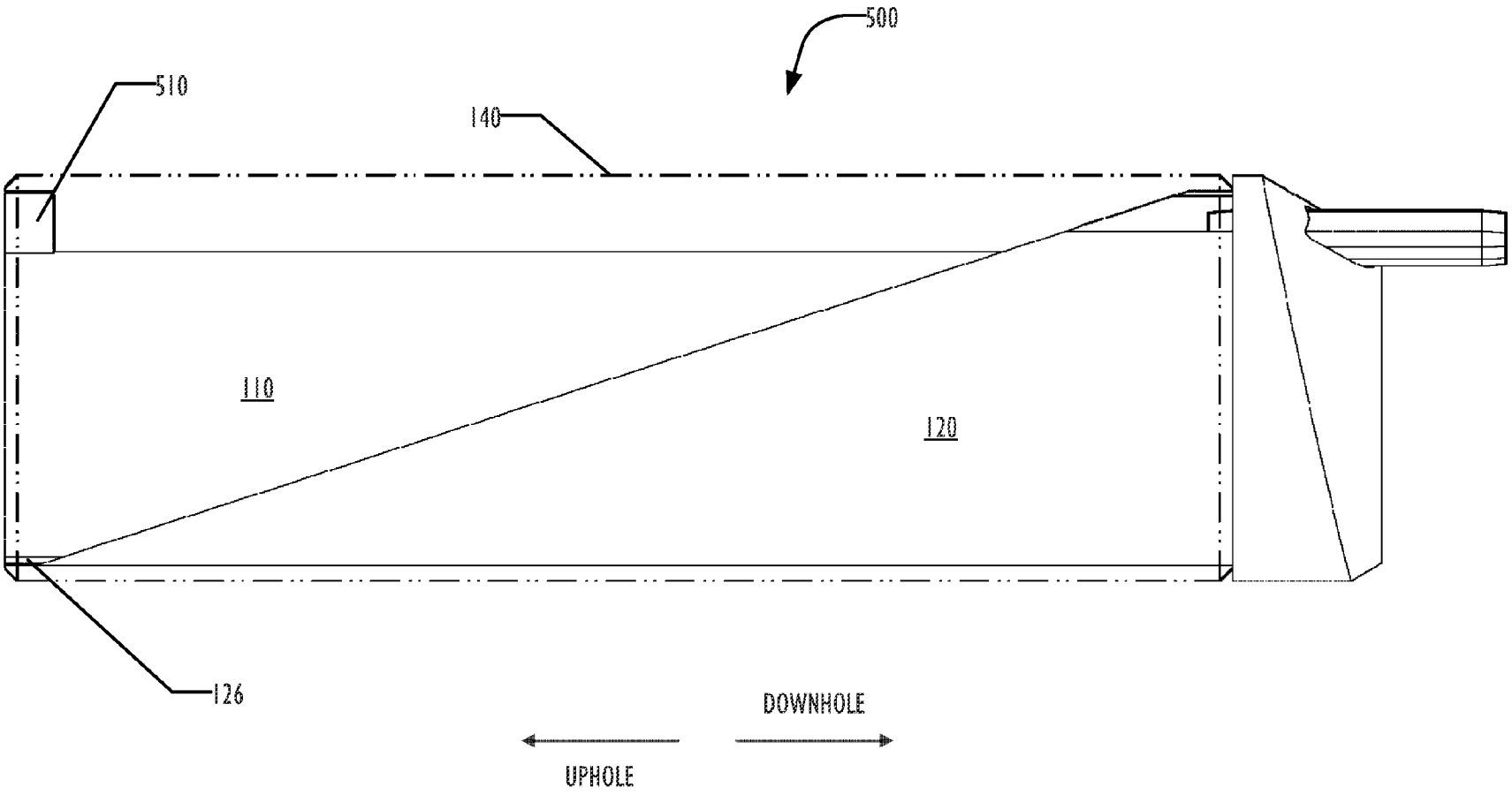
FIG. 7 is a top view of the entry tube system of FIG. 5.
Figure 8:
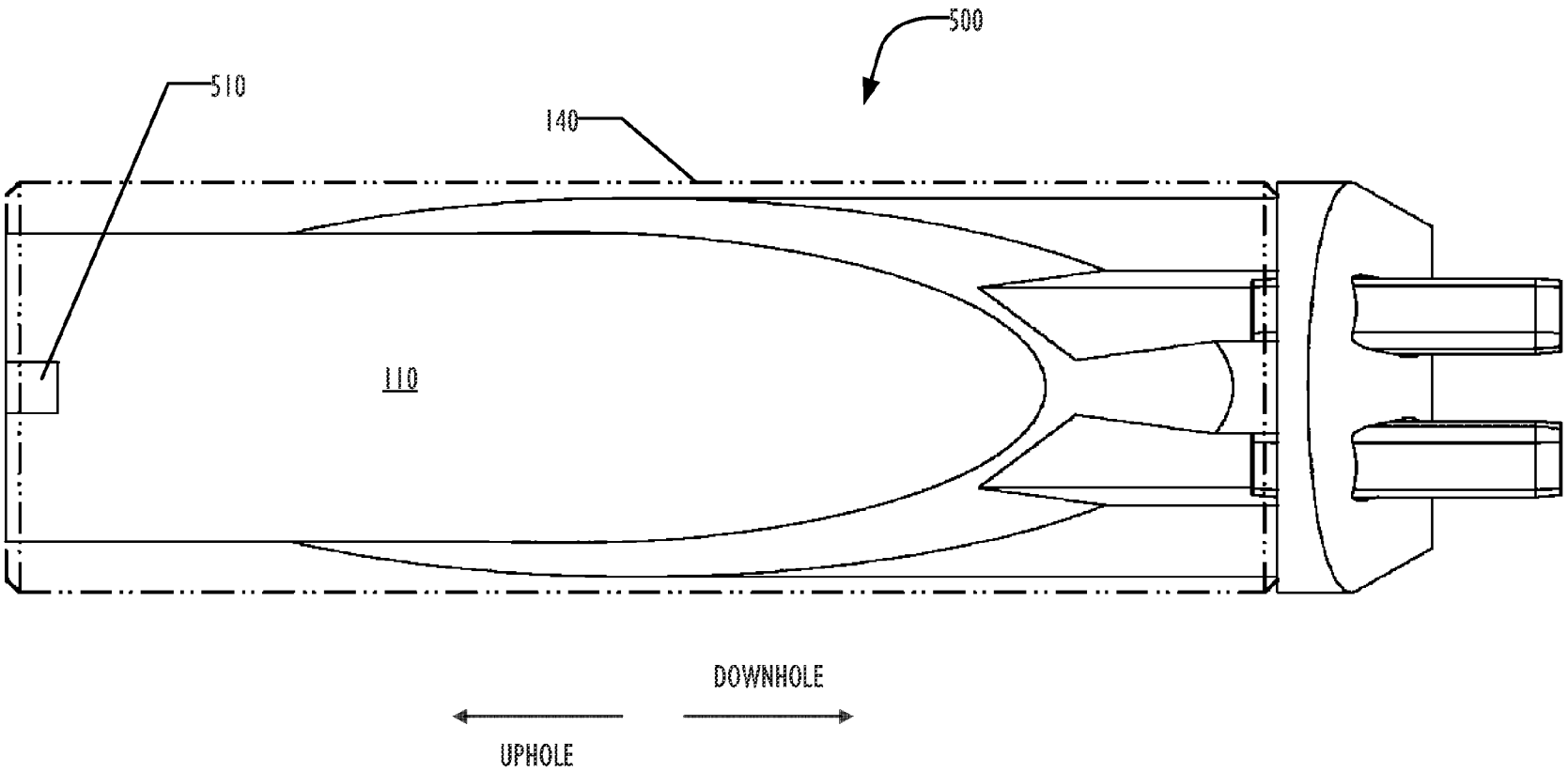
FIG. 8 is a side view of the entry tube system of FIG. 5.
Figure 9:
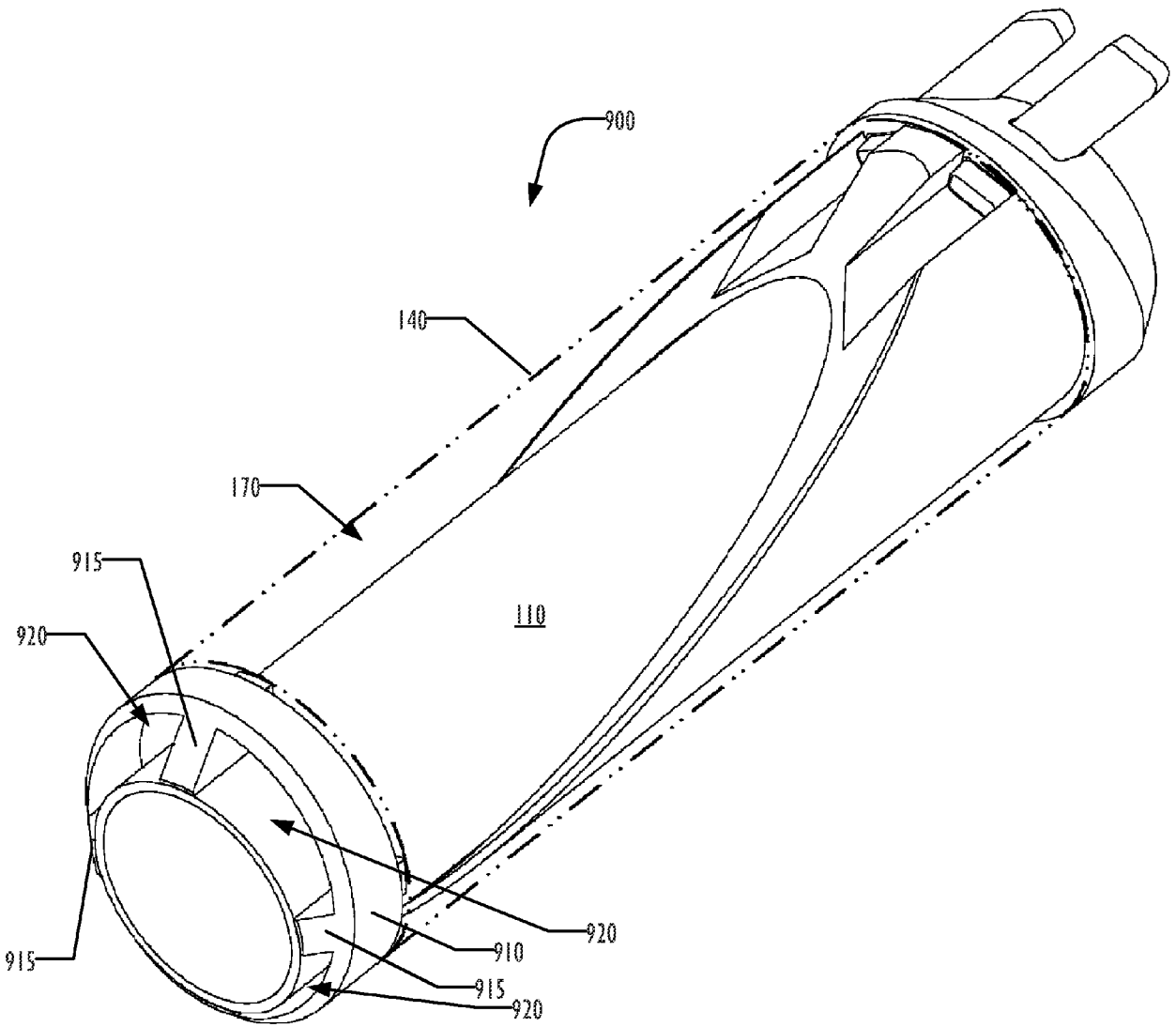
FIG. 9 is an isometric view of an entry tube system according to yet another embodiment.

As illustrated in FIGS. 5-8, no uphole end section 160 is provided, but further embodiments may include a uphole end section 160 or other similar member to provide protection to the uphole end of the cover section 140 and/or inner mandrel 110, to avoid damage to the entry tube system 500 when moving the entry tube system 500 in an uphole direction and to provide non-squared surfaces to avoid catching the uphole end of the entry tube system 500 on projections from a casing or wellbore during uphole movement. The member 510 may be placed at any desired circumferential position about the inner mandrel 110, and multiple members 510 may be provided as desired. Although illustrated in FIGS. 5-8 disposed at the uphole edge of the inner mandrel 110 and cover section 140, the member 510 may be offset downhole from the uphole edge a short distance as desired. As best illustrated in FIG. 6, the member 510 may be sized to interfere minimally with flow of fluid through the inlet 610 formed into the chamber 170 between the uphole end of the inner mandrel 110 and the uphole end of the cover section 140. As best illustrated in FIG. 7, the nose element 126 in this embodiment, if present, may extend only to the uphole edges of the inner mandrel 110 and cover section 140, and may be affixed to the inner mandrel 110.

FIGS. 9-12 illustrate an entry tube system 900 according to yet another embodiment. In this embodiment, an uphole end section 910 is formed with a plurality of integral support members 915 to provide support at a plurality of locations about the circumference of the inner mandrel 110. Except for the uphole end of the entry tube system 900 as described below, the entry tube system 900 may be identical to the entry tube system 100.

Figure 10:
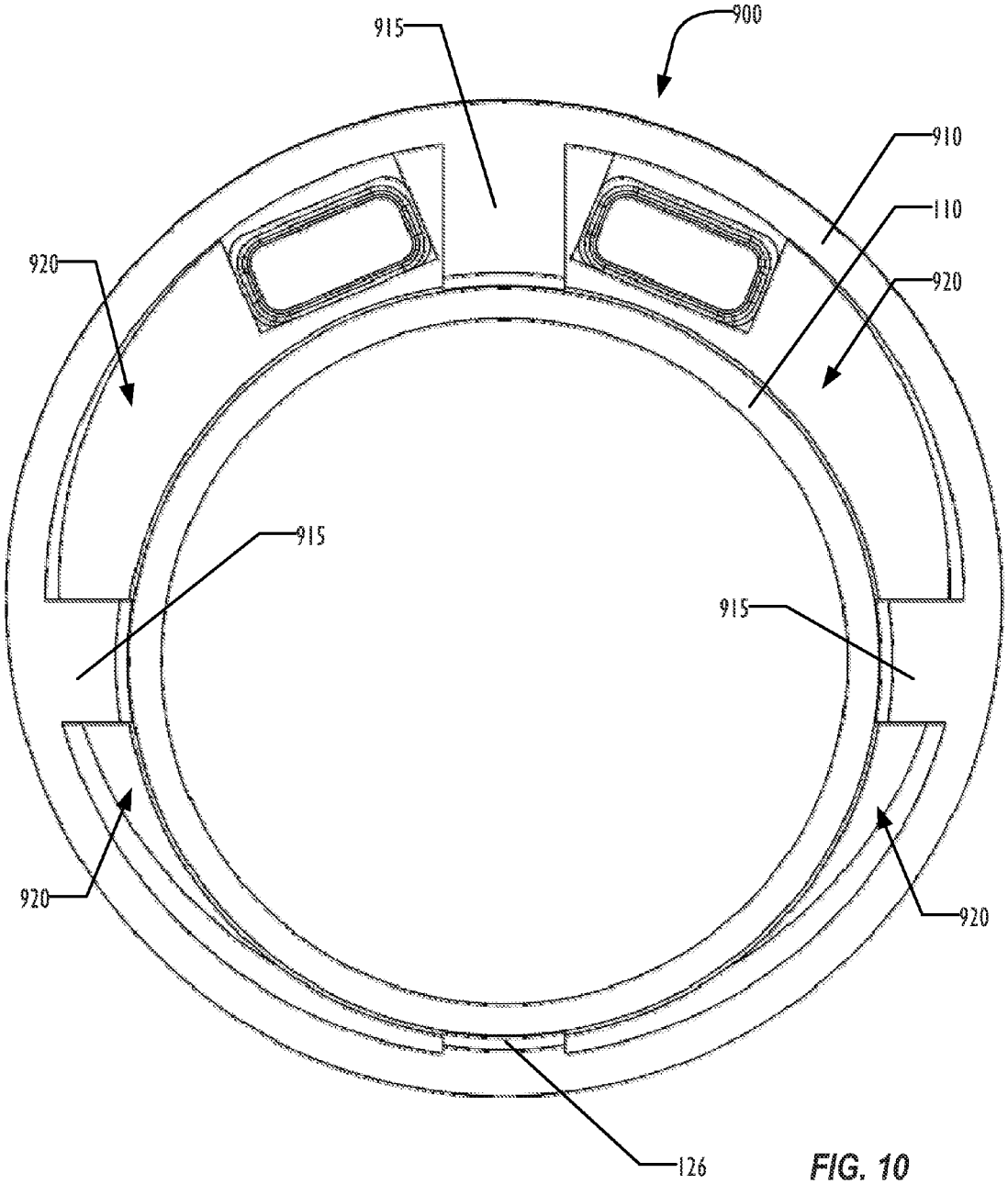
FIG. 10 is an end view of the entry tube system of FIG. 9.

In this embodiment, multiple inlets 920 into the chamber 170 are formed by the placement of the integral support members 915 of the uphole end section 910. The integral support members 915 are preferably sloped in a downhole direction where they extend radially inward from the circumference of the uphole end section 910. Although as best illustrated in FIG. 10, three support members 915 are provided, any number, including one, may be provided.

Figure 11:
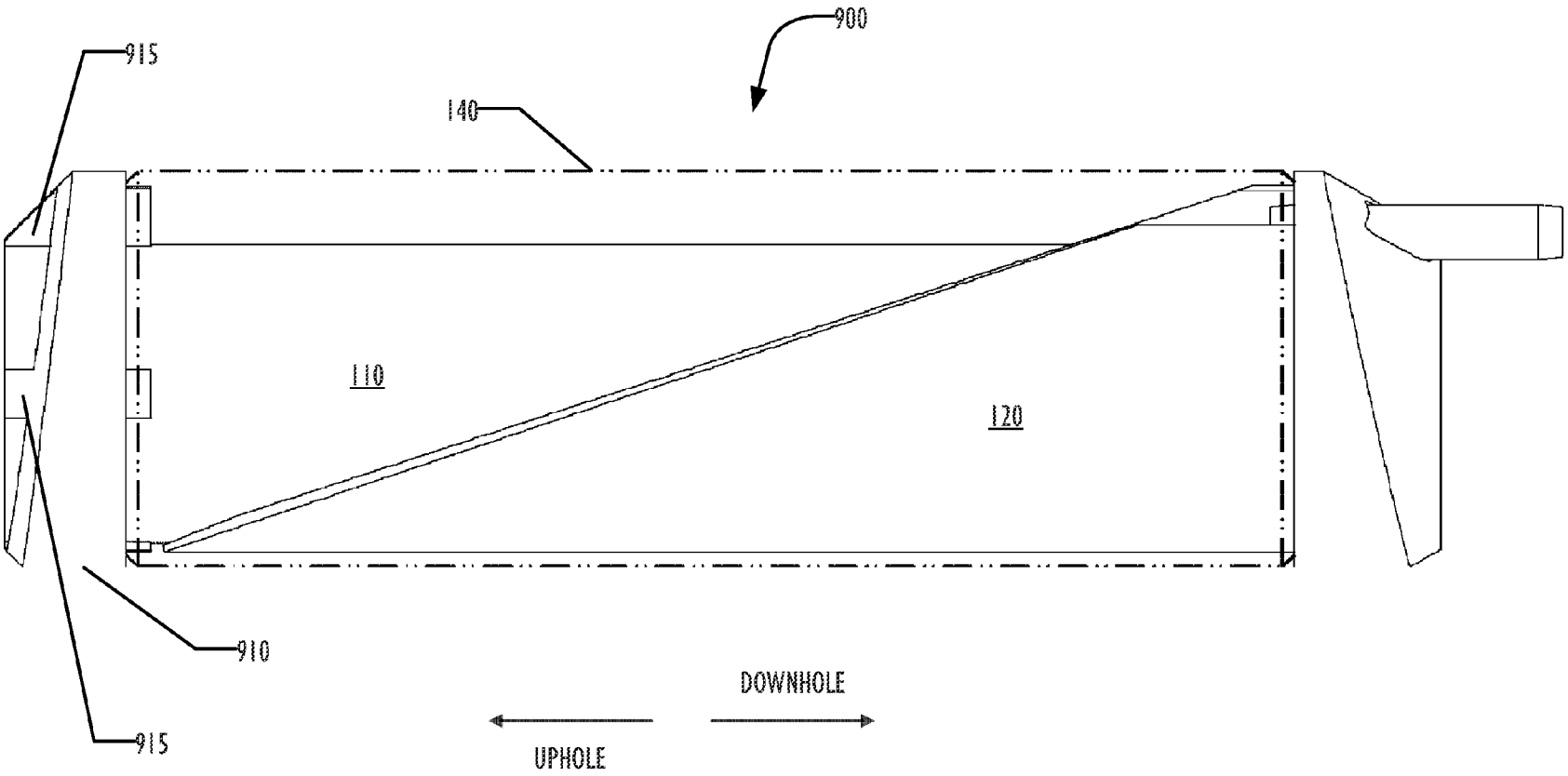
FIG. 11 is a top view of the entry tube system of FIG. 9.
Figure 12:
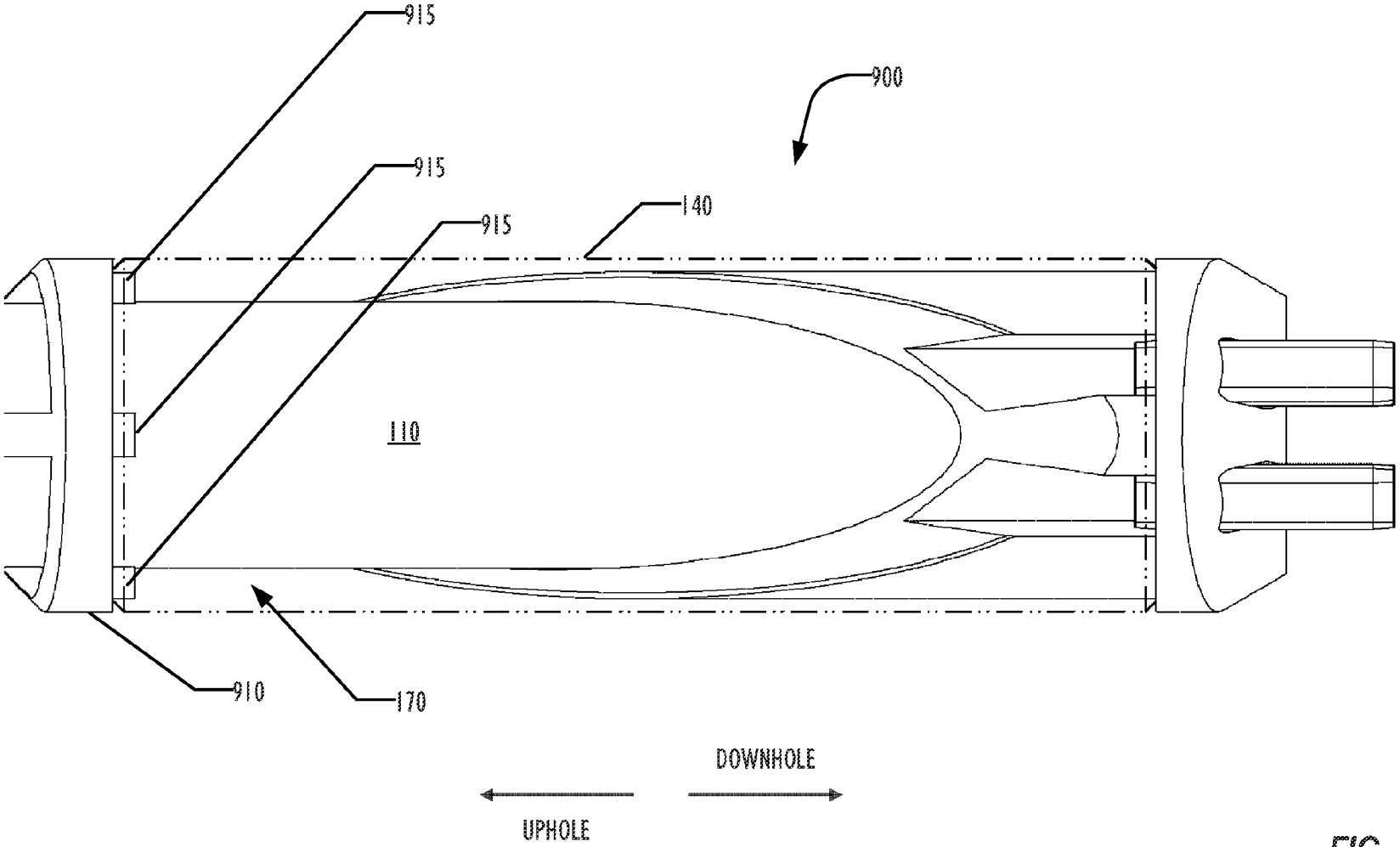
FIG. 12 is a side view of the entry tube system of FIG. 9.
Figure 13:
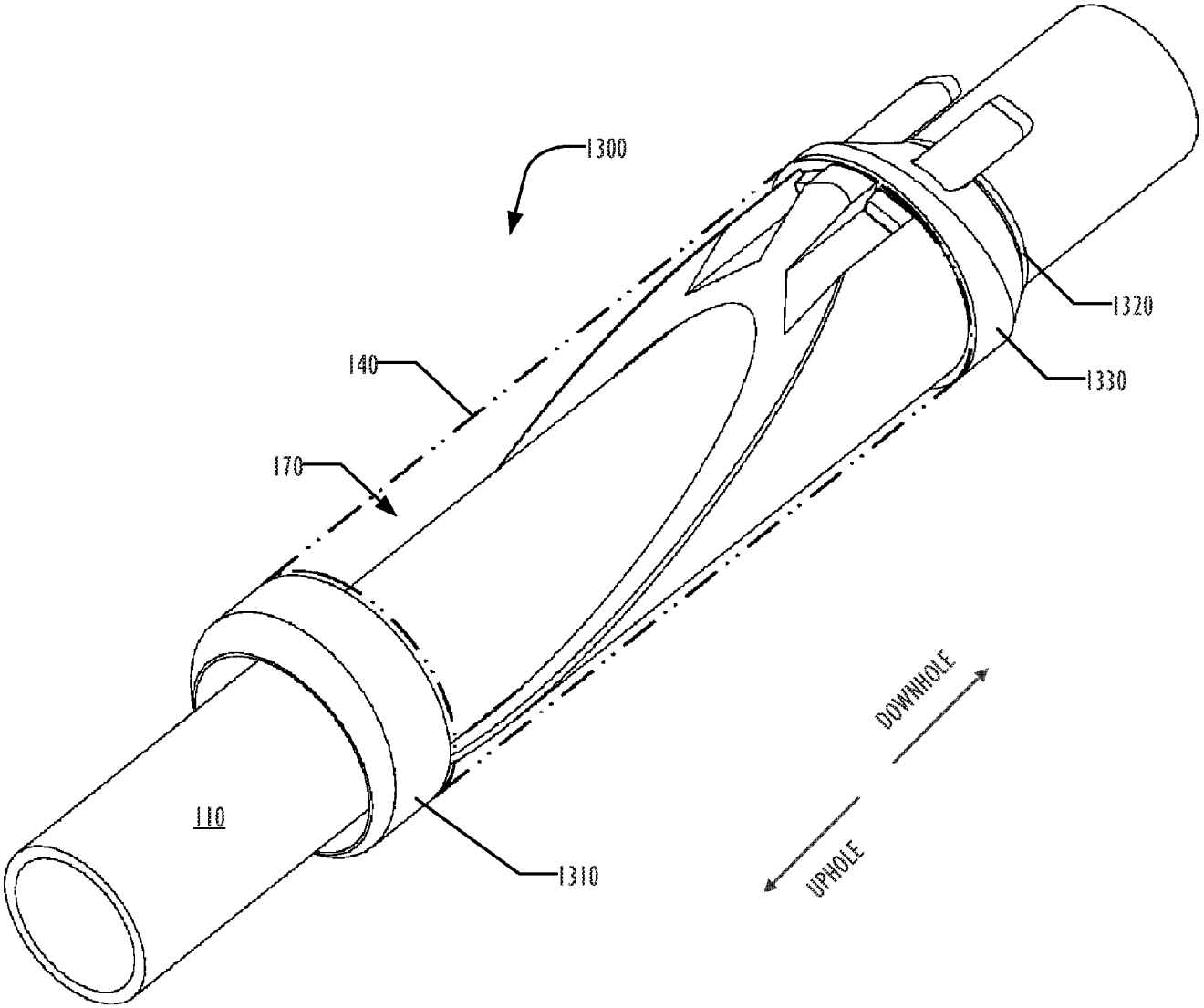
FIG. 13 is an isometric view of an entry tube system according to yet another embodiment.

As best illustrated by FIGS. 11 and 12, the support members 915 may extend downhole of the main portion of the uphole end section 910 into the chamber 170, providing additional support for the uphole end of the cover section 140. Although in this embodiment there are multiple inlets 920 into the chamber 170, the chamber 170 continues to provide a single undifferentiated path through the chamber 170 about the inner mandrel 110 as in the other embodiments described herein. In addition, the combined multiple inlets 920 allow fluid communication about substantially all of the circumference of the inner mandrel 110.

FIGS. 13-16 illustrated an entry tube system 1300 according to yet another embodiment. In this embodiment, the uphole end of the inner mandrel 110 does not provide support to the uphole end section 1310 or the uphole end of the cover section 140. Instead, the entry tube system 1300 supports the inner mandrel 110 at the downhole end of the entry tube system 1300. Except as described below, the entry tube system 1300 may be identical to the entry tube system 100. In this embodiment, inner mandrel 110 may be formed by a section of base pipe that extends through the entry tube system 1300, and is connected to other portions of the completion string in any manner known to the art.

Figure 14:
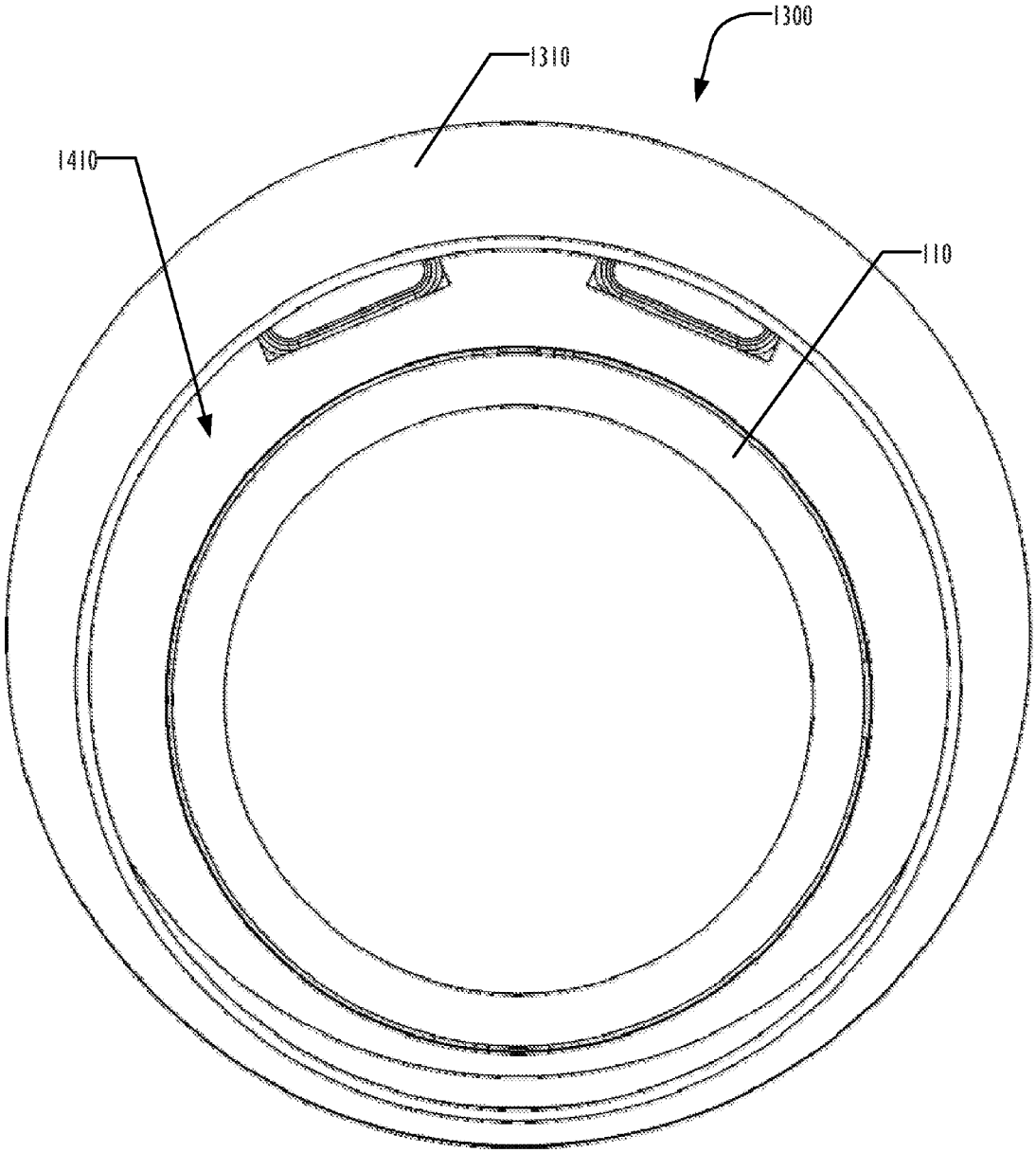
FIG. 14 is an end view of the entry tube system of FIG. 13.

In this embodiment, a stop ring 1320 is disposed on the inner mandrel 110 at a predetermined location, and is affixed by welding or other techniques to the inner mandrel 110. The downhole end section 1330 is configured to mate with the stop ring 1320, allowing the entry tube system 1300 to be slid along the inner mandrel 110 to the stop ring 1320, then welded or otherwise affixed to the stop ring 1320. Affixing the downhole end section 1330 to the stop ring 1320 provides support to keep the uphole end section 1310 and cover section 140 spaced away from the inner mandrel 110, forming a single full-circumference inlet 1410 about the inner mandrel 110 into the chamber 170, as best illustrated in FIG. 14.

Although as illustrated in FIGS. 13-16 with an uphole end section 1310, in one embodiment, the uphole end section 1310 may be omitted, similar to the embodiment illustrated in FIGS. 5-8. In other embodiments, any of the configurations of the uphole end illustrated in FIGS. 1-12 may be provided for additional support of the inner mandrel 110 and cover section 140.

Figure 15:
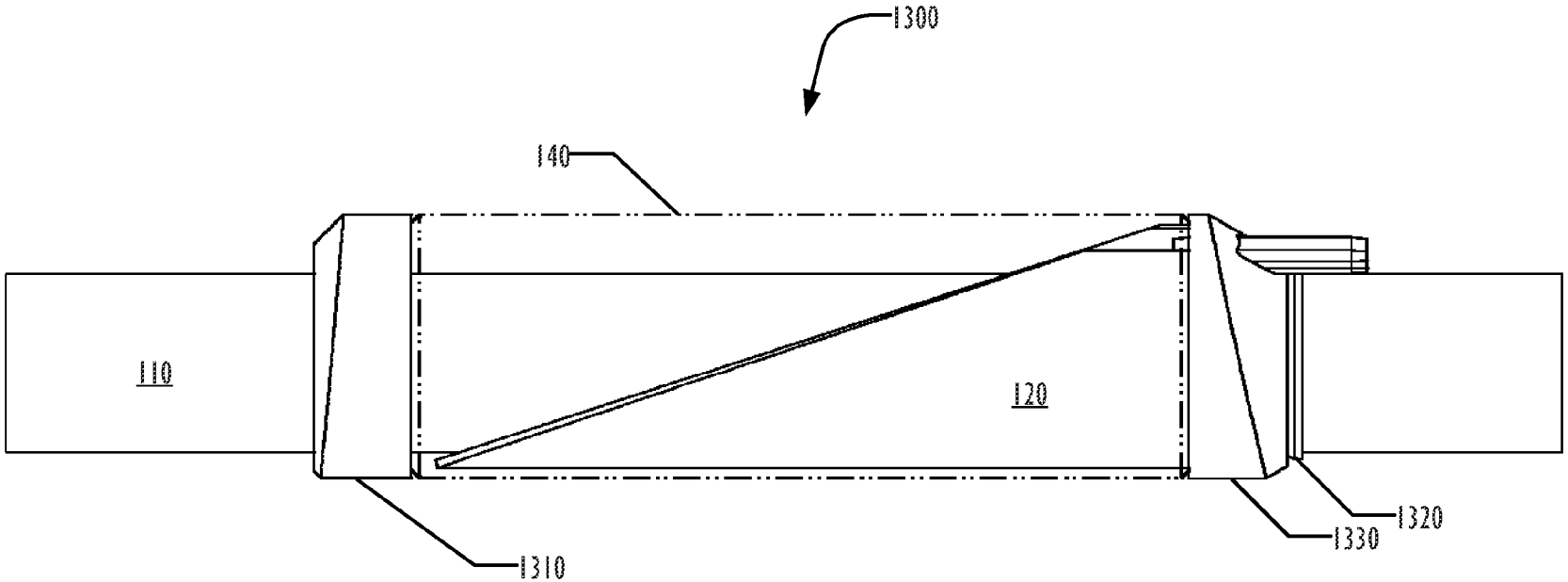
FIG. 15 is a top view of the entry tube system of FIG. 13.
Figure 16:
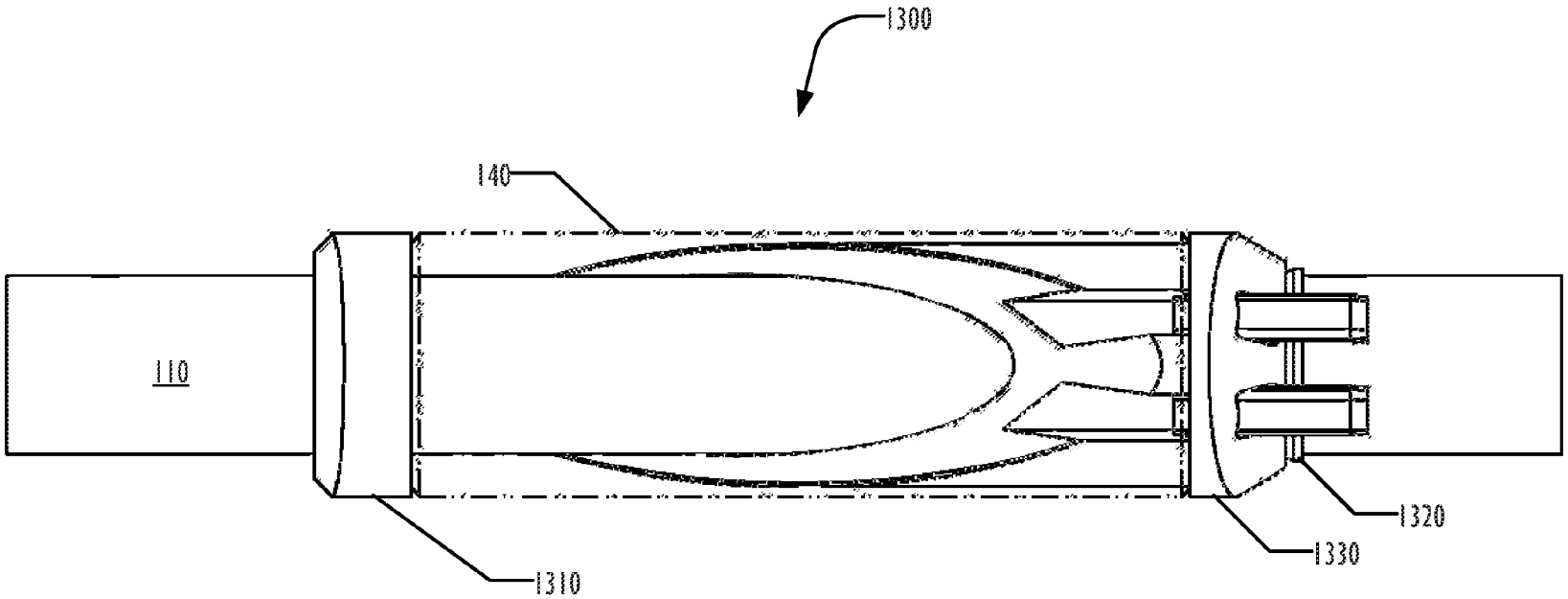
FIG. 16 is a side view of the entry tube system of FIG. 13.
Figure 17:
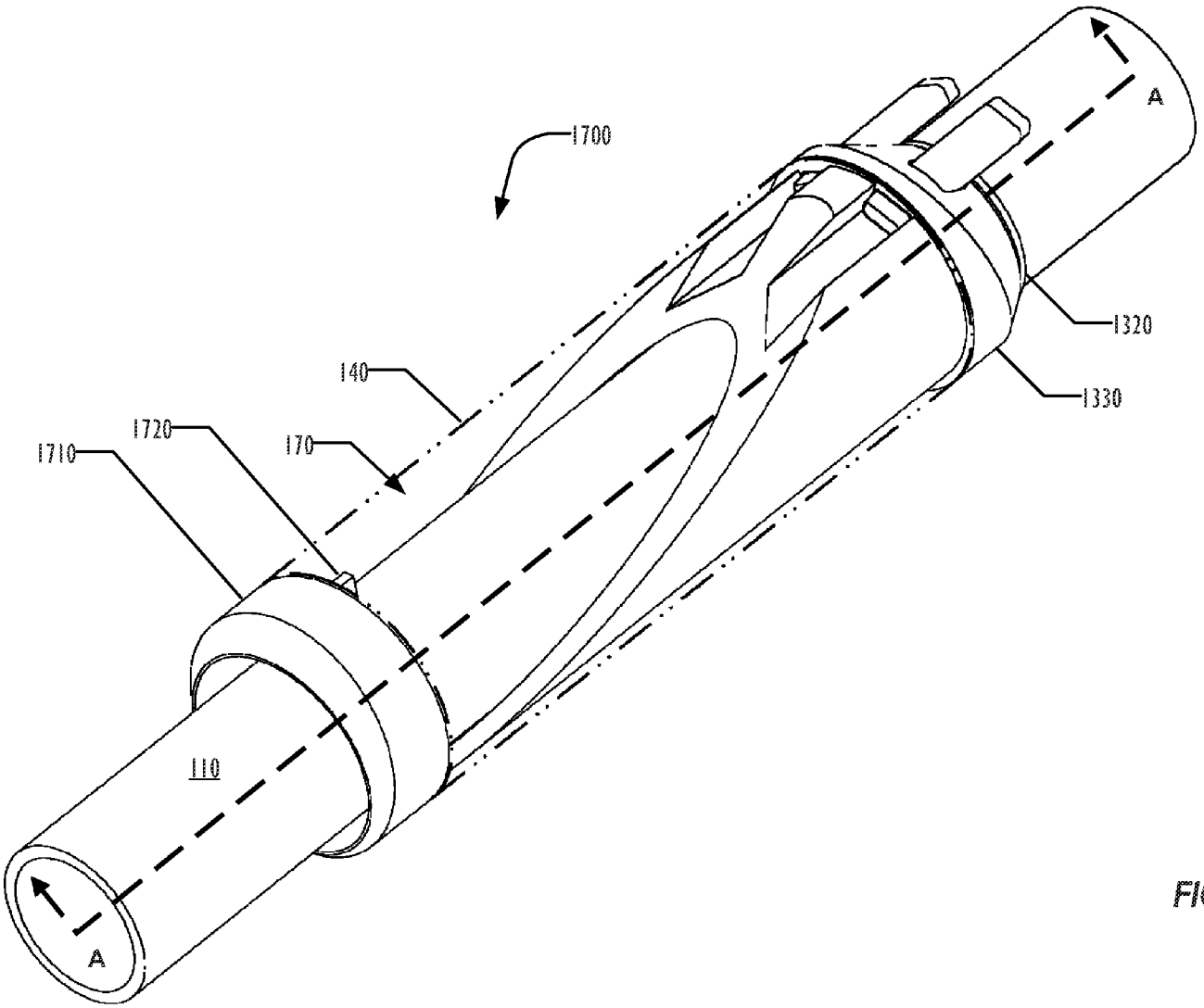
FIG. 17 is an isometric view of an entry tube system according to yet another embodiment.

As best illustrated in FIG. 15, in one embodiment, the uphole end of the guide member 120 may end downhole of the uphole end section 1310. In other embodiments, the guide member 120 may extend to or through the uphole end section 1310, including providing a nose element 126 as illustrated in FIGS. 1-4.

FIGS. 17-20 illustrated an entry tube system 1700 according to yet another embodiment. In this embodiment, the uphole end of the inner mandrel 110 provides support to the uphole end section 1710 and the cover section 140 by way of a keyed member 1720. Except as described below, the entry tube system 1700 may be identical to the entry tube system 1300.

Figure 19:
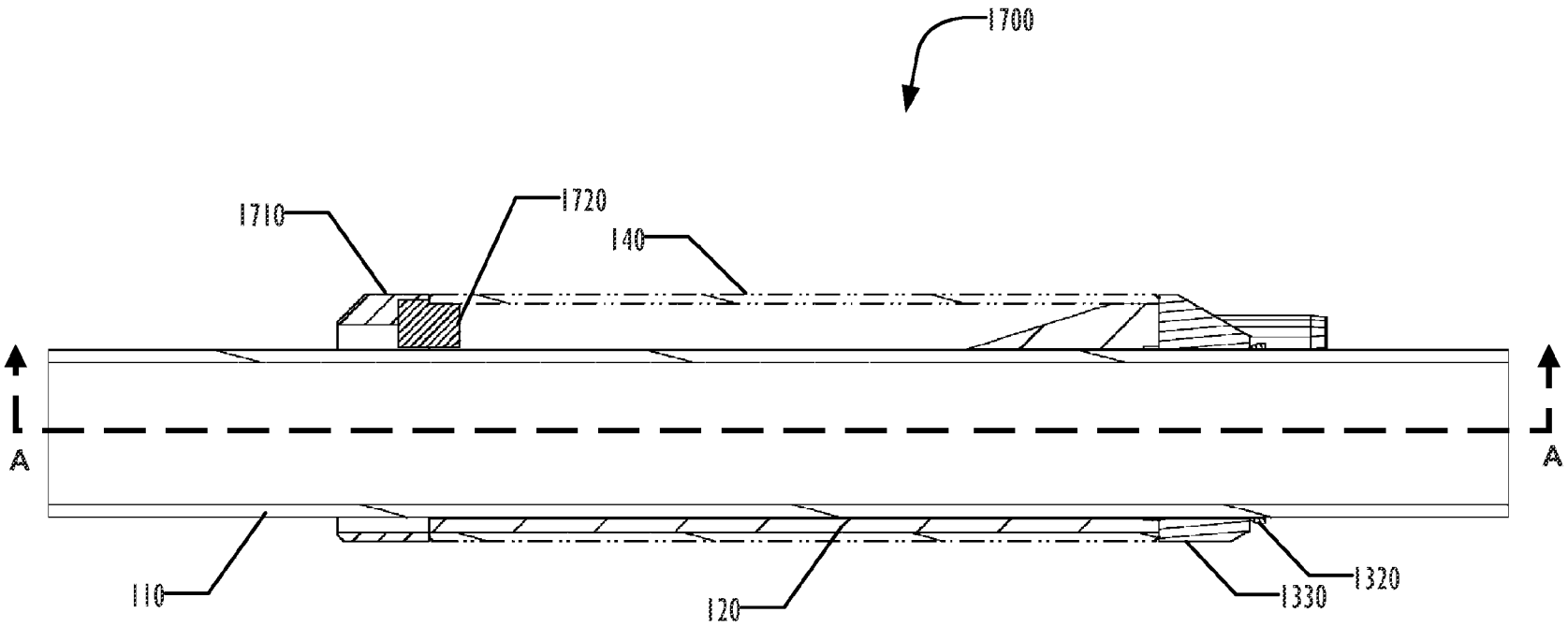
FIG. 19 is a top view of the entry tube system of FIG. 17.

FIG. 19 is a cross-sectional view taken along line A-A of the entry tube system 1700. A keyed member 1720 is formed to be held between uphole end section 1710 and cover section 140, extending radially inward from those element to the inner mandrel 110 to provide support. In one embodiment, the keyed member 1720 is welded to the uphole end section 1710 and/or cover section 140, but is not welded or otherwise affixed to the inner mandrel 110. In other embodiments, the keyed member may 1720 be trapped between the uphole end section 1710 and cover section 140, without being welded to either. Thus, the keyed member 1720 and inner mandrel 110 are slidably movable relative to each other when initially positioning the entry tube system 1700 along the inner mandrel 110 to the stop ring 1320, where the downhole end section 1330 may be welded or otherwise affixed to the stop ring 1320.

Figure 18:
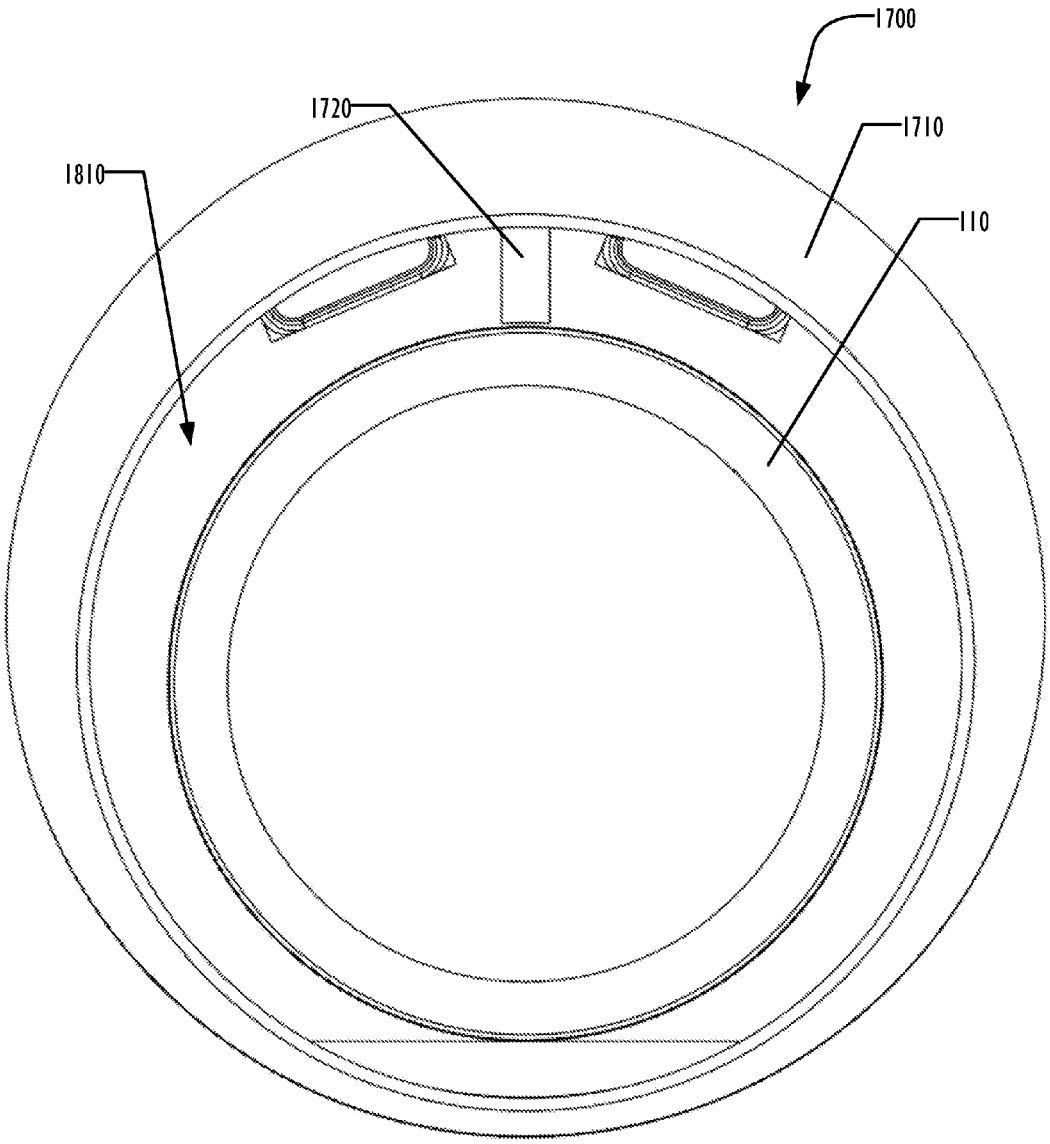
FIG. 18 is an end view of the entry tube system of FIG. 17.

In this embodiment, the keyed member 1720 provides additional support, but is sized and configured to minimize interference with fluid flowing through the single inlet 1810 into the chamber 170 formed between the uphole end section 1710 and the inner mandrel 110, as best illustrated in FIG. 18. As with the inlet 1410 of the entry tube system 1300 of FIGS. 13-16, the single inlet 1810 extends about the entire circumference of the inner mandrel 110. As with the embodiment of FIGS. 13-16, in this embodiment the guide member 120 may extend up to the downhole end of the uphole end section 1710, or may have a nose element 126 such as is illustrated in FIGS. 1-4.

Figure 20:
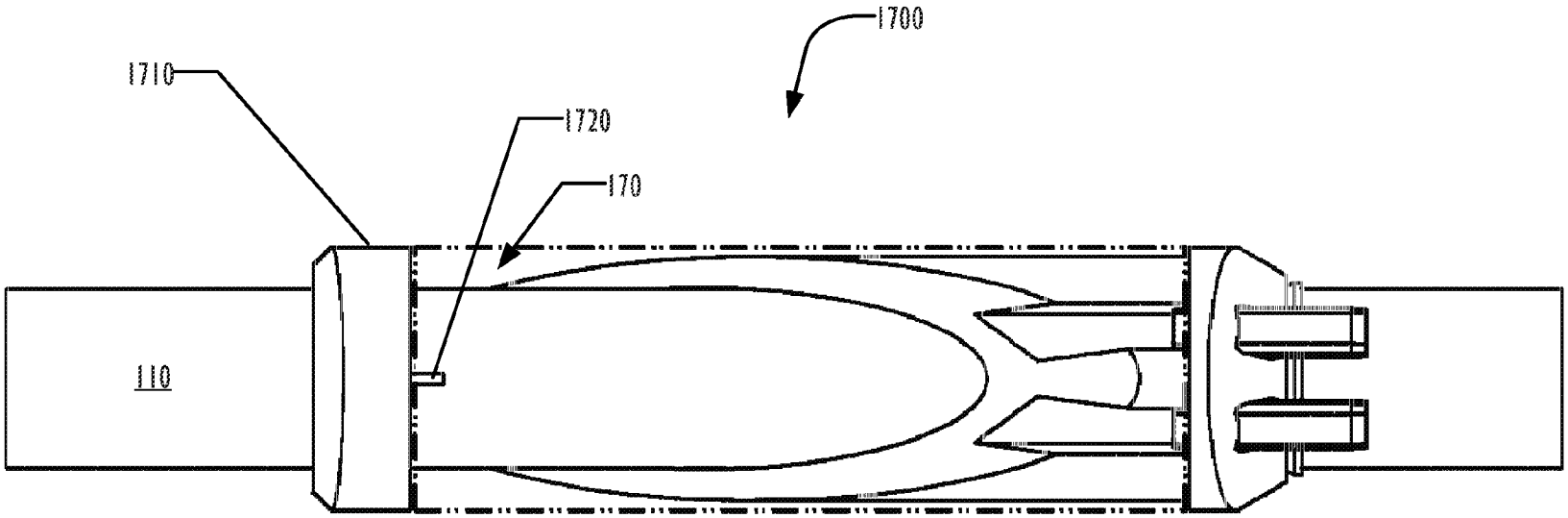
FIG. 20 is a side view of the entry tube system of FIG. 17.

As best illustrated in FIG. 20, the keyed member 1720 may extend into the chamber 170 to provide support to the cover section 140.

It is to be understood that the above description is intended to be illustrative, and not restrictive. For example, the above-described embodiments may be used in combination with each other and elements of one embodiment may be combined with elements of other embodiments. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A downhole tool, comprising:

an entry tube;

an inner mandrel, disposed within the entry tube, an outer surface of the inner mandrel forming a chamber between the inner mandrel and an inner surface of the entry tube about the entire circumference of the inner mandrel; and a shunt tube, extending longitudinally through a downhole end of the entry tube, in fluid communication with the chamber, wherein a single inlet into the chamber is formed between the inner mandrel and the entry tube, the single inlet allowing fluid entry into the chamber about substantially all of the circumference of the inner mandrel at an uphole end of the entry tube.

2. The downhole tool of claim 1, wherein the entry tube is configured to allow fluid communication into the chamber about all of the circumference of the inner mandrel at the uphole end of the entry tube.

3. The downhole tool of claim 1, further comprising:

a guide member, disposed about the inner mandrel in the chamber, comprising a tapered surface from a first position along the inner mandrel to the shunt tube.

4. The downhole tool of claim 3, wherein the shunt tube extends through the downhole end of the entry tube into the chamber, and wherein the guide member comprises a channel formed in a portion of the tapered surface aligned with the shunt tube.

5. The downhole tool of claim 3, further comprising:

a downhole end section, disposed at a downhole end of the downhole tool, wherein the guide member is affixed to the downhole end section.

6. The downhole tool of claim 3, wherein the entry tube comprises an end section, disposed at the uphole end of the entry tube, and wherein the guide member comprises a nose section, affixed to the end section.

7. The downhole tool of claim 3, wherein the tapered surface comprises a straight taper.

8. The downhole tool of claim 3, wherein the guide member is formed of a material harder than the inner mandrel.

9. The downhole tool of claim 1, wherein the entry tube comprises:

a cover section; and a downhole end section, disposed at a downhole end of the cover section, wherein the chamber is formed between the inner mandrel and an inner surface of the cover section.

10. The downhole tool of claim 9, wherein the entry tube further comprises:

an uphole end section, disposed at an uphole end of the cover section.

11. The downhole tool of claim 10, wherein the entry tube further comprises:

a member disposed between the cover section and the inner mandrel, wherein the member is keyed to fit between the uphole end section and the cover section, and wherein the member and the inner mandrel are slidably moveable relative to each other during assembly of the downhole tool.

12. The downhole tool of claim 10, wherein the shunt tube is disposed with the downhole end section.

13. The downhole tool of claim 9, wherein the entry tube further comprises:

a member disposed between the cover section and the inner mandrel.

14. The downhole tool of claim 13, wherein the member is affixed to the inner mandrel.

15. The downhole tool of claim 1, wherein the entry tube is positioned on a completion string tubular by sliding the tubular through the inner mandrel.

16. The downhole tool of claim 1, wherein inner mandrel comprises connectors for connecting the entry tube to a completion string tubular.

17. The downhole tool of claim 1, wherein the entry tube is positioned on the inner mandrel by sliding the inner mandrel through the entry tube during assembly of the downhole tool.

18. The downhole tool of claim 1, further comprising:

a restriction member, disposed with the uphole end of the entry tube, configured to prevent fluid flow into the chamber below a predetermined fluid pressure.

19. The downhole tool of claim 1, further comprising:

a stop ring disposed at a predetermined position along the inner mandrel; and a downhole end section, disposed at a downhole end of the entry tube, configured to mate with the stop ring, wherein the downhole end section is affixed to the stop ring, wherein the inner mandrel comprises a section of base pipe.

20. A method, comprising:

forming a chamber in an entry tube, comprising:

disposing an inner mandrel within the entry tube, an outer surface of the inner mandrel forming the chamber about the entire circumference of the inner mandrel between the outer surface of the inner mandrel and an inner surface of the entry tube;

providing fluid communication into the chamber about substantially all of a circumference of the inner mandrel at an uphole end of the entry tube via a single inlet into the chamber formed between the inner mandrel and the entry tube; and forming an outlet from the chamber via a shunt tube extending longitudinally through a downhole end of the entry tube.

21. The method of claim 20, further comprising:

guiding fluid to the outlet across a tapered surface disposed within the chamber.

22. The method of claim 21, further comprising:

disposing an uphole end section at the uphole end of the entry tube; and affixing a nose of the tapered surface to the uphole end section.

23. The method of claim 21, wherein forming a chamber in an entry tube further comprises:

forming a channel in a portion of the tapered surface proximal to the outlet, aligned with the outlet.

24. The method of claim 20, further comprising:

guiding fluid flow about the outer surface of the inner mandrel.

25. The method of claim 20, wherein forming an outlet from the chamber comprises:

disposing a downhole end section with a downhole end of the entry tube; and disposing a shunt tube longitudinally through the downhole end section, the shunt tube in fluid communication with the chamber.

26. The method of claim 25, wherein disposing a shunt tube longitudinally through the downhole end section comprises:

positioning an end of the shunt tube flush with an inner surface of the downhole end section.

27. The method of claim 20, wherein forming a chamber in an entry tube comprises:

disposing an uphole end section with the uphole end of the entry tube; and disposing a downhole end section with a downhole end of entry tube, and wherein forming an outlet from the chamber comprises:

forming an opening in the downhole end section, in fluid communication with the chamber.

28. The method of claim 20, further comprising:

restricting fluid entry into the chamber at pressures below a predetermined threshold pressure.

29. The method of claim 20, further comprising:

disposing a stop ring at a predetermined position along the inner mandrel;

disposing a downhole end section with a downhole end of the entry tube, the downhole end section configured to mate with the stop ring;

sliding the entry tube and the downhole end section along the inner mandrel to mate with the stop ring; and affixing the downhole end section to the stop ring, wherein the inner mandrel comprises a section of base pipe.

30. The method of claim 20, further comprising:

affixing a support member between the inner mandrel and the entry tube.

31. The method of claim 30, wherein affixing a support member between the inner mandrel and the entry tube comprises:

disposing an uphole end section with the uphole end of the entry tube; and holding the support member between the uphole end section and the entry tube.

32. The method of claim 20, further comprising:

forming an uphole end section configured for affixing to the uphole end of the entry tube, wherein the uphole end section comprises a support member configured to support the inner mandrel within the uphole end section.

* * * * *